United States Patent [19]

Howerton et al.

[11] Patent Number: 5,076,393

[45] Date of Patent: Dec. 31, 1991

[54] ENGINE EXHAUST MUFFLER

[76] Inventors: Kenneth R. Howerton, 4200 N. Libby, Oklahoma City, Okla. 73122; Derrell Smith, P.O. Box 6772, Moore, Okla. 73160

[21] Appl. No.: 611,701

[22] Filed: Nov. 13, 1990

[51] Int. Cl.[5] ..... F01N 1/08

[52] U.S. Cl. ..... 181/264; 181/265; 181/268; 181/272; 181/282

[58] Field of Search ..... 181/264, 265, 266, 268, 181/269, 272, 282, 283

[56] References Cited

U.S. PATENT DOCUMENTS

| | | | |
|---|---|---|---|
| 702,031 | 6/1902 | Ronan . | |
| 937,665 | 10/1909 | Walton . | |
| 1,700,993 | 2/1929 | Bernet et al. . | |
| 1,844,105 | 2/1932 | Schnell . | |
| 2,229,913 | 1/1941 | Blanchard | 181/56 |
| 2,707,525 | 5/1955 | Janeway | 181/56 |
| 3,470,979 | 10/1969 | Everett | 181/265 |
| 4,006,793 | 2/1977 | Robinson | 181/265 |
| 4,064,962 | 12/1977 | Hunt | 181/272 |
| 4,137,993 | 2/1979 | Rutt | 181/282 |
| 4,359,134 | 11/1982 | Jackson | 181/230 |
| 4,550,799 | 11/1985 | Flugger | 181/244 |

*Primary Examiner*—Brian W. Brown
*Assistant Examiner*—Khanh Dang
*Attorney, Agent, or Firm*—Laney, Dougherty, Hessin & Beavers

[57] ABSTRACT

A muffler for muffling engine operating sound and including a double-walled cylindrical shell closed at opposite ends by double-walled closure caps. The space between the shell walls is filled with sound-absorbing solid particles. The shell is partitioned into three axially contiguous chambers. A gas charging pipe projects through one closure cap and axially within the shell, and has two pairs of facing discharge elbows for discharging gas from the charging pipe at locations in the first chamber. A first pair of gas transfer pipes extends from the first chamber into the central chamber to points of opposed gas discharge. A second pair of gas transfer pipes extends from the central chamber into the third or discharge chamber, and from this location, the gas passes out of the muffler via a discharge pipe.

6 Claims, 2 Drawing Sheets

ENGINE EXHAUST MUFFLER

FIELD OF THE INVENTION

This invention relates to a large muffler which is connectable to the hot exhaust gas pipe from a large internal combustion engine, and which functions to muffle or attenuate the sound which is developed by the engine during operation.

BACKGROUND OF THE INVENTION

Brief Description Of The Prior Art

Various types of mufflers have heretofore been proposed for use in conjunction with large internal combustion engines for dampening or attenuating the sound made by the hot gases exhausted from the engine as these gases are vented to the atmosphere. In general, such mufflers include tubular elements which have various shapes, numbers and configurations of baffles located on the inside of the external tubular member. The baffles are generally for the purpose of causing the gas to flow through a tortuous or circuitous route in passing from the inlet to the muffler to the exit thereof.

Many mufflers include some sort of packing material or sound absorbing material located in the interior of the muffler, or at least in the outer wall thereof, for dampening the sound made by the escaping hot gases which pass through the muffler when the engine to which it is attached is in use. In general, while certain isolated principles of sound attenuation have been recognized and utilized in various types of muffler designs, I believe that an optimum combination of these features has not been achieved, or at least has not worked as effectively as the combination which I have discovered, and which I now bring before the U.S. Patent and Trademark Office for evaluation, and, hopefully, issuance of a patent thereon.

U.S. Pat. No. 937,665 to Walton discloses a muffler which disposes of hot exhaust gases wherein the gas flow within the muffler is divided into two opposing streams by means of which the gases in the two streams are caused to impinge against each other at several points along the path of flow through the muffler. The muffler housing includes a plurality of baffle plates which include opposed nozzles through which the gas flows, and in being so directed by these nozzles, encounters opposing gas streams so that interference results. The baffle plates utilized in the muffler divide it into three substantially equal sized compartments.

Ronan U.S. Pat. No. 702,031 proposes to divide the hot exhaust gases entering the muffler into two opposing streams and these are then caused to impinge against each other and ultimately to escape into the air from one end of the muffler. The muffler is divided into two substantially equi-sized compartments, and the exhaust gases flow out through a volute located approximately in the center of the muffler.

U.S. Pat. No. 1,700,993 to Bernet et al depicts a plurality or concentric, opposing channels developed by partition plates located inside a muffler, with these channels lying in a substantially longitudinal direction. In these channels, the gas streams impinge against each other. Each concentric channel is defined within the muffler by a longitudinally disposed baffle plate. The flow within the muffler is from the outside flow path inwardly to the next radially inner flow path, and so forth, until the energy depleted exhaust gases reach the center of the muffler.

In Jackson U.S. Pat. No. 4,359,134, a sound-suppressor for air and hot gases is depicted in which the muffler or suppressor comprises a pair of aligned branch passages having a common inlet trunk, and having a common outlet trunk and having the appearance of an 0-shaped hollow member with arms projecting from the opposite sides thereof. One of the branch passages in the soundsuppressor contains a flow restricting orifice, and the other of the branch passages is unobstructed.

U.S Pat. No. 2,229,913 to Blanchard proposes to divide the incoming hot gas flow into two pipes which diverge from each other as they project further inwardly toward the center of the muffler. The hot gases from these two divergent pipes are then re-merged by impinging the gases against each other at a location near the center of the muffler. From this location, the gases pass into the exhaust pipe from the muffler.

Schnell U.S. Pat. No. 1,844,105 describes a muffler in which a shell is filled with sound absorbing material, which can be any porous, sound deadening material, including "sized, crushed mineral matter", "mica", "exfoliated vermiculite", "brown slag", "coke", "pumice", or other porous aggregate material.

Other muffler patents include Rutt U.S. Pat. No. 4,137,993, Janeway U.S. Pat. No. 2,707,525 and U.S. Pat. No. 4,550,799 which locates a sound absorbing material between an inner skin and an outer skin disposed at the radially outer side of the hollow muffler body.

There has been no prior appreciation of which I am aware of the effect of sizing the several axially arranged contiguous chambers within a muffler according to a certain volumetric size ratio or dimensional correspondence, concurrently with the recognition that it is important to properly size the by-pass or pass through tubes or pipes which extend through partitions in the muffler in order to deliver an optimum relative amount of the hot gases from one chamber to the next in order to contribute to sound reduction optimization, along with a minimal interference with efficient engine operation.

BRIEF DESCRIPTION OF THE PRESENT INVENTION

The present invention provides an elongated compact cylindrical muffler for us in muffling the sound of operation of a large internal combustion engine. The muffler is connected to a discharge pipe carrying the exhaust gases from the engine, and by direction and selective treatment of these gases, effectively attentuates the sound of operation of the engine. Moreover, the muffler does not impair the efficient operation of the engine due to excessive increase in back pressure or the like.

Broadly described, the muffler of the invention includes an elongated cylindrical body which is of a double-walled construction. A particulate solid material of good sound attenuating properties is located between two relatively thin skins of metal forming the double walls. The interior of the double-walled shell is divided into three compartments which are critically sized relative to each other and relative to the cross-sectional area of the incoming hot gas exhaust pipe in a way important to the achievement of maximum sound attenuation.

The gas entering the muffler is divided into multiple streams at several points with these streams being directed back against each other so that the impinging hot gases dissipate a substantial portion of their kinetic energy by such impingement. The sound thus tends to be attenuated both by impacting the gases from multiple outlets against each other, as well as from the circuitous route through which the gases are made to pass.

An important object of the invention is to provide an improved sound attenuating muffler which can be used on large internal combustion engines to achieve very effective sound suppression or attenuation.

A further object of the invention is to provide an effective muffling system which can receive the hot exhaust gases from a large internal combustion engine, and by direction and treatment of these hot exhaust gases, eliminate a substantial part of the gases and attenuate the sound developed during the operation of the engine.

Another object of the invention is to provide a muffler system for attachment to an internal combustion engine, which muffler system is relatively economical in construction and relatively compact in size.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
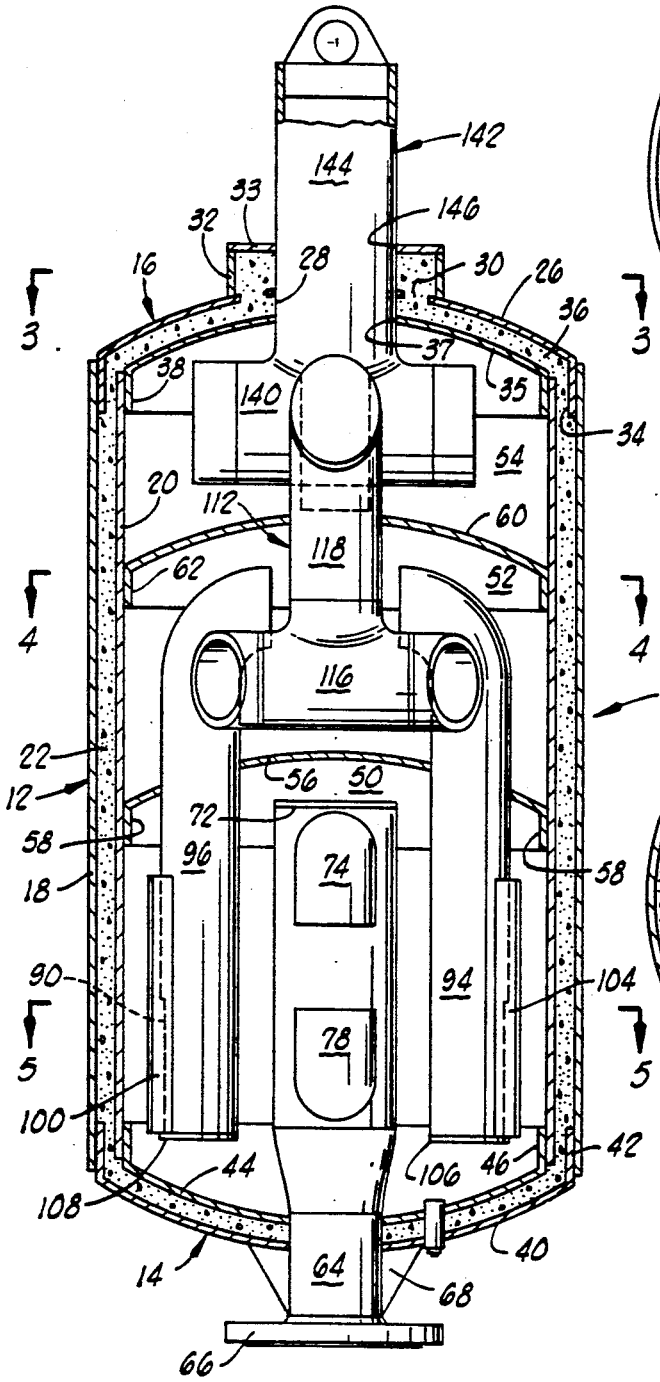
FIG. 1 is a vertical sectional view through the exterior shell of the muffler of the invention, and illustrating the internal piping within the shell in elevation.

The muffler of the invention includes a generally cylindrical double-walled external shell, designated generally by reference numeral 10. The double-waled shell 10 includes an elongated cylindrical central portion 12 which is closed at its opposite ends by a pair of double-walled concavo-convex closure caps. These include a bottom closure cap 14 and an upper or top closure cap 16.

The construction of the cylindrical central portion 12 of the double-walled shell 10 includes an outer metallic cylindrical skin 18 and an inner metallic cylindrical skin 20. The space between the outer skin 18 and inner skin 20 is filled with a solid particulate material 22 having good sound absorbing qualities. Fine dry cement can be effectively employed.

Figure 3:
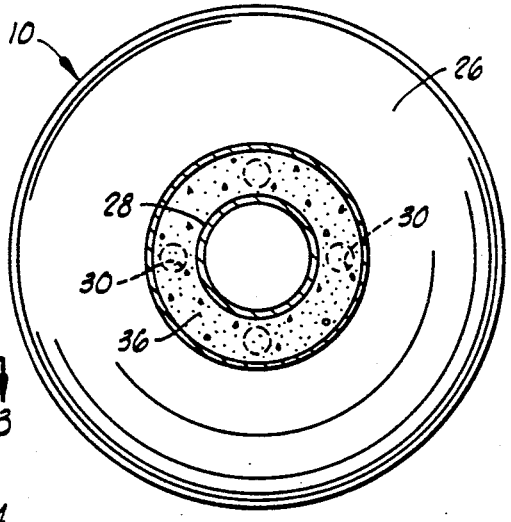
FIG. 3 is a sectional view taken along line 3—3 of FIG. 1.

The upper end closure cap 16 includes a concavo-convex outer skin 26 which has a central circular opening 28 therethrough to accommodate a discharge pipe provided for the discharge of gases passed through the muffler in a manner hereinafter described. Around the central circular opening, the outer shell or skin 18 is provided with a plurality of circumferentially spaced openings 30 (see FIGS. 1 and 3). The openings 30 are provided to permit the space between the inner and outer skins of the external shell to be filled with the solid particulate sound absorbing material 22 previously mentioned. A short cylindrical neck 32 is secured to the outer side of the outer skin 26 of the end cap 16 and projects axially therefrom in a concentric relationship to the circular opening 28 through the outer skin. A centrally apertured end plate 33 extends transversely across the open outer end of the neck 32. The outer skin 26 of the upper closure cap 16 carries an axially extending circumferential flange 34 which is dimensioned to provide a press fit within the outer skin 18 of the tubular central section 12.

The top closure cap 16 also includes a concavo-convex inner skin 35 which is spaced from the outer skin and defines therewith a space 36. The inner skin 35 defines a centrally positioned circular opening 37 for the accommodation of a cylindrical discharge pipe hereinafter described. The inner skin 35, like the outer skin 26 of the upper end closure cap 16, carries an axially extending circumferential flange 38. The flange 38 projects substantially parallel to the flange 34 and is dimensioned to provide a press fit within the inner skin 20 of the elongated cylindrical central portion 12 of the double-walled external shell.

At the opposite end of the generally cylindrical double-walled external shell 10, the bottom closure cap 14 includes a concavo-convex outer skin 40 which carries an axially extending circumferential flange 42 which is dimensioned to provide a press fit within the outer skin 18 of the tubular central section 12. The bottom closure cap 14 also includes a concavo-convex inner skin 44 which carries an axially extending circumferential flange 46 which is dimensioned to provide a press fit within the inner skin 20 of the tubular central section 12.

The interior of the muffler is divided into three contiguous chambers denominated by reference numerals 50, 52 and 54. The first or entrance chamber 50 is located between the bottom closure cap 14 and a concavo-convex partition plate 56 which carries a peripheral flange 58 by means of which the partition plate can be welded or otherwise suitably secured to the inner skin 20 of the double-walled central cylindrical portion 12 of the shell 10. The intermediate compartment or chamber 52 is defined between the partition plate 56 and a second concavo-convex partition plate 60 which carries a peripheral flange 62 facilitating joinder of this partition plate to the inner skin 20 of the central cylindrical section 12. The discharge chamber or third compartment 54 is defined between the partition plate 60 and the top closure cap 16.

As will be subsequently explained, the volumetric ratio of the three axially contiguous chambers or compartments 50, 52, and 54 within the interior of the muffler is important to the achievement of one of the major objects of the invention, i.e. maximization of sound reduction commensurate with an acceptable level of back pressure to the engine to which the muffer is connected. The volumetric ratios of the three compartments to each other is actually best stated in terms of the volumetric ratio of each of the compartments to the cross-sectional area of the exhaust line from the engine at the point where the exhaust line enters the muffler, and thus, at that point, constitutes the intake or charging line to the muffler.

Figure 2:
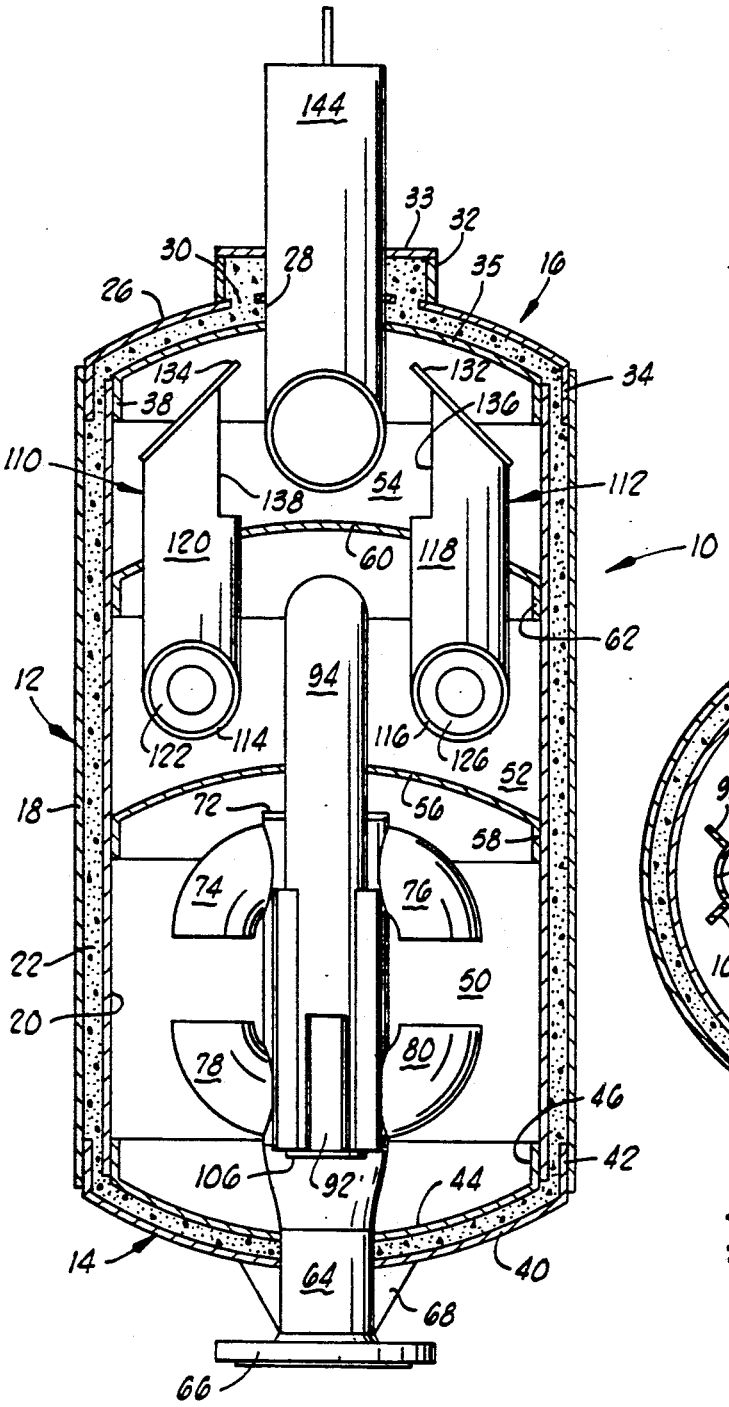
FIG. 2 is a view similar to FIG. 1 but illustrating the muffler as it appears when rotated about its vertical axis through 90° from the position shown in FIG. 1.

The engine exhaust line or pipe which constitutes the intake pipe or line entering the muffler is best illustrated in FIGS. 1 and 2 of the drawings, and is there denominated by reference numeral 64. The exhaust line 64 from the engine carries a connecting flange 66 at its outer end, and is generally cylindrical in configuration. It is mounted on the bottom closure cap 14 by means of a plurality of gusset plates 68. The exhaust pipe 64 passes through a circular opening in the bottom end cap 14 and then flares to a slightly larger diameter a it extends axially toward the center of the chamber or compartment 50.

Figure 5:
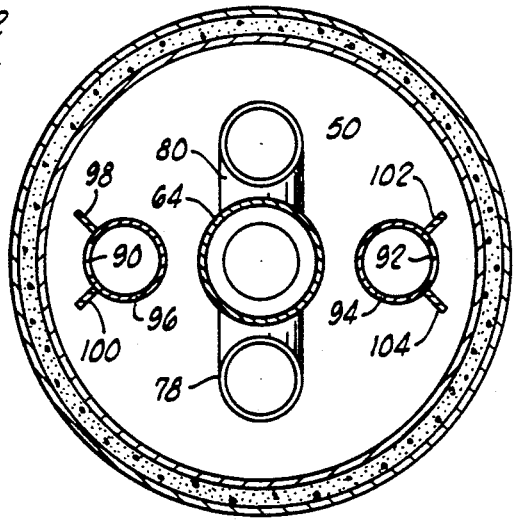
FIG. 5 is a sectional view taken along line 5—5 of FIG. 1.

The engine exhaust pipe 64 is oriented along the central axis of the generally cylindrical muffler, and thus it is positioned primarily in the center of the entrance chamber or compartment 50. At this location, the exhaust pipe has an end portion which is closed by a closure plate 72. The exhaust pipe 64 is ported around its periphery for connection thereto of a plurality of circumferentially-spaced L-shaped elbow fittings 74–80. The elbow fittings are mounted in pairs, 74–76 and 78–80 on the closed exhaust pipe 64 within the chamber 50, so that the discharge from the elbow fittings in each pair impinges, or is directed against, the discharge from the oppositely facing fitting in the other pair. This arrangement is best illustrated in FIGS. 1, 2 and 5. Here, the open ends of the elbows in each pair of elbows are oppositely turned so that their discharge openings face each other within each of the pairs. Thus, the hot gases which are being discharged from the two elbows in each pair of elbows impinge against each other at a point approximately midway between the two facing elbows.

Reference to FIGS. 1, 2 and 5 will thus reveal that the elbow 76 discharges hot gases from the exhaust pipe 64 against hot gases being discharged upwardly from the oppositely facing elbow 80. In the same fashion, hot gases discharged downwardly from the elbow 74 impinge against hot gases discharged upwardly from the elbow 78.

Figure 4:
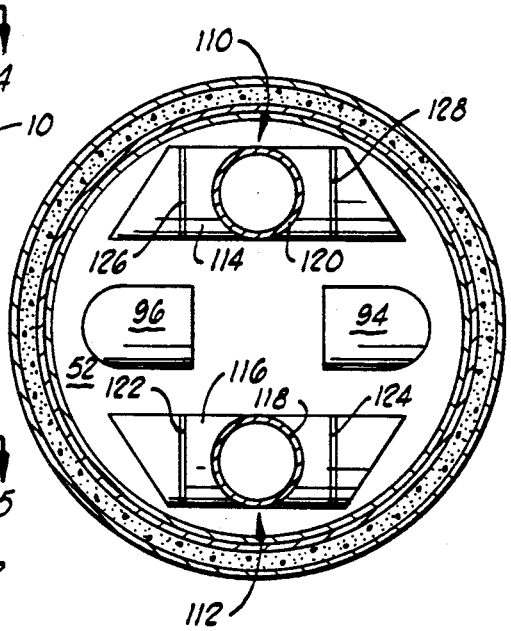
FIG. 4 is a sectional view taken along line 4—4 of FIG. 1.

After the gases from the two pairs of elbows 74–80 have passed into the chamber 50, these gases pass radially outwardly and are able to enter axially extending elongated openings 90 and 92 formed in a pair of upwardly extending generally cylindrical transfer pipes 94 and 96. It will be noted that the transfer pipes 94 and 96 are located 180° around the chamber 50 from each other, and are offset 90° from the elbows 74–80. In order to engender turbulence in the gas flow within the chamber or compartment 50, and prior to the time the hot gases enter the elongated openings 90 and 92, a pair of radially outwardly extending elongated baffle plates 98 and 100 are disposed on openings of the transfer pipes 94 and 96, the gases change direction and move radially outwardly, as well as upwardly, in the chamber 52. By such movements, the gases are able to ultimately enter the open ends of two horizontally extending pickup pipe sections forming the cross bar of T-shaped transfer pipe subassemblies, designated generally by reference numerals 110 and 112. The pickup sections of the transfer pipe subassemblies 110 and 112 are denominated by reference numerals 114 and 116, respectively, and are illustrated in FIGS. 1, 2 and 4.

Each of the pickup sections 114 and 116 has an opening at its center where it is joined to a respective upwardly extending leg 118 and 120 of the respective transfer pipe subassembly 110 or 112. At its opposite ends, each of the pickup sections 114 and 116 is cut on a bias or bevel, as perhaps is best shown in FIG. 4. This angulation of the opening into the respective pickup section in each case orients the opening to face toward the walls of the chamber or compartment 52. This causes the hot gases to flow through a greater distance in order to enter the openings formed in the end of the pickup sections than would be the case, if, for example, the openings were disposed in a diametric plane of the pickup sections.

In the case of each of the horizontally extending pickup sections 114 and 116, a pair of flow restrictor plates are located inwardly from the opening and define a restricted opening of relatively smaller diameter through which the gases must pass opposite sides of the opening 90 in the transfer pipe 96, and a pair of elongated upwardly extending radially outwardly projecting baffle plates 102 and 104 are located on opposite sides of the opening 92 into the transfer pipe 94. The bottom of the transfer pipe 94 is closed by a suitable closure plate 106, as shown in FIGS. 1 and 2, and a similar closure plate 108 closes the upwardly extending transfer pipe 96.

The transfer pipes 94 and 96 both pass through the partition plate 56 into the compartment or chamber 52. At the upper end of the cylindrical transfer pipe 96, it is curved through a 90° angle so as to discharge hot gases in a horizontal direction across the chamber 52. Similarly, after the transfer pipe 94 projects through the partition 56 into the chamber 52, it carries a curved end which discharges hot exhaust gases in a horizontal direction which is directly opposite the direction of flow of gases from the transfer pipe 96. Thus, the hot gases from the transfer pipes 94 and 96 impinge upon each other by being directed in the opposite direction from the oppositely facing openings at the upper ends of these transfer pipes. It may be commented at this point that the diametric sizes of the two transfer pipes 94 and 96 is of some criticality to the proper functioning of the muffler of the invention, and this dimensional desiderata will be explained hereinafter.

After the hot gases have entered the chamber 52 after impinging against each other on discharge from the facing in order to reach the ascending or vertically extending legs of the transfer pipe subassemblies. Thus, in the pickup section 114, a pair of restrictor plates 126 and 128 are located inwardly from the opposite ends of the pickup section 114, and in the pickup section 116, a pair of similar restrictor plates 122 and 124 are similarly positioned. Of these, plates 124 and 126 can perhaps be best perceived where they are shown in FIG. 2 of the drawings. After the hot exhaust gases have passed into the ends of the pickup sections 114 and 116, and then passed through the restrictor plates 122–128, the hot gases enter the upwardly extending leg 118 in the case of the transfer pipe subassembly 112, and the upwardly extending leg 120 in the case of the transfer pipe subassembly 110.

The upper end of the upwardly extending leg 118 of the transfer pipe 112 is also cut on an angle or bias, and is covered by a closure plate 132. In similar fashion, the angled opening at the upper end of the upwardly extending leg 120 of the transfer pipe 110 is closed by a closure plate 134. A gas discharge opening is formed at the radially inwardly facing side of the upwardly extending leg 118 of the transfer pipe subassembly 112, and is denominated by reference numeral 136. Similarly, a gas discharge opening facing radially inwardly is formed at the upper end of the upwardly extending leg 120 of the transfer pipe subassembly 110 and is denominated by reference numeral 138.

It will again be noted by reference to FIGS. 1 and 2 that hot gases discharged from the upper ends of the two transfer pipe subassemblies 110 and 112 are caused to impinge against each other, inducing substantial turbulence in the gases and thereby aiding in noise reduction and heat dissipation. The transfer pipe subassemblies 110 and 112, as shown in FIGS. 1 and 2, function to transfer hot gases from the central compartment 52 to the compartment or chamber 54 in the upper end of the muffler.

The hot gases discharged through the openings 136 and 138 at the facing upper ends of the upwardly extending legs 118 and 120 of the transfer pipe subassemblies 110 and 112, respectively, impinge to a small degree against each other. These gases also impinge against the side of a horizontally extending pickup leg 140 of a T-shaped discharge pipe subassembly, designated generally by reference numeral 142. The discharge pipe subassembly 142 includes, in addition to the pickup leg 140, a vertically extending discharge leg 144. The discharge leg 144 extends through the opening 37 in the inner shell 20 of the double-skinned housing and on through the opening 28 formed through the outer skin 26, and finally through a central opening 146 formed through the closure 33 at the upper end of the muffler. Gases discharged into the upper chamber or compartment 54 from the transfer pipe subassemblies 110 and 112 exit the muffler via the T-shaped discharge pipe subassembly 142. In undergoing such discharge, the hot gases enter the openings at the opposite ends of the horizontally extending pickup leg 140, then move to a central location where, after impinging against each other, the hot gases enter the vertically extending discharge leg 144, and from there pass out at the top of the muffler to the atmosphere.

OPERATION

In the operation of the muffler of the invention, sound attenuation is accomplished in several ways. The sound of the engine operation from which the hot gases originate is attenuated in part by the fine particulate material 22 which is packed between the internal and external skin of the wall of the muffler. This material has a relatively low coefficient of sound transfer and accomplishes significant damping and attenuation of the sound.

Further attenuation is accomplished by "beating" the hot gases against each other, or, stated differently, discharging the hot gases from openings at the end of transfer pipes which face each other, so that some of the energy of the gases is dissipated in the impingement of the gases against each other and in the turbulence which is thus generated. As has been earlier pointed out herein, a certain overall optimum attenuation has been found to be accomplished by the sizing of the internal chambers within the muffler relative to the discharge pipe from the internal combustion engine which is connected to the muffler, and by the sizing of the various tubes, conduits and pipes by which the discharge gases are conveyed through the muffler.

Considering the various dimensional relationships and ratios which are required to achieve enhancement of the sound attentuation constituting the primary function of the muffler, the various volumetric dimensions of the several internal chambers or compartments 50, 52 and 54 can best be related to the size of the engine exhaust line or pipe 64. Thus, the first chamber or compartment 50 is the largest of the three compartments, and it has been found that this chamber or compartment should have a volume in cubic inches which is from about 580 to about 780 times the area in square inches of the engine exhaust line or pipe 64 at the place where it first enters the muffler through the lower end cap 14.

The second or intermediate chamber 52 is smaller than the first chamber 50, but larger than the final chamber or compartment 54. The intermediate or central chamber 52 should be, for most effective sound suppression, between about 420 and 445 times the area, in square inches, of the gas discharge pipe 64 where it enters the muffler. Preferably, the central chamber is about 340 times the described cross-sectional area of the engine exhaust pipe.

The discharge chamber or compartment 54 is from about 340 to 360 times the cross-sectional area of the engine exhaust pipe, with the optimum size being about 340 times the cross-sectional area of the exhaust pipe. These volume to area ratios of the several compartment volumes-to-engine discharge pipe cross-sectional areas have been found to be the best ratios for achieving optimum noise suppression, with no unacceptable effect on the back pressure developed to the engine in terms of its effect on engine longivity or operating life and economy and efficiency of operation. If the back pressure to the engine is too low, this will cause a reduction in horsepower developed by the engine. If it is too high the engine will run hot, and the service life will be reduced.

The transfer pipes 94 and 96 by which gases are transferred from the compartment 50 to the intermediate chamber or compartment 52, should have a cumulative or total cross-sectional area (that is, the cross-sectional areas of the two pipes added together) which is 125% ±5% of the cross-sectional area, in square inches, of the engine exhaust pipe 64.

In similar fashion, the total cross-sectional area of the vertical or upwardly extending legs 118 and 120 of the transfer pipes 110 and 112 in cumulative cross-sectional area of the openings through the restrictor plates 122 and 126 is 125% ±5% of the total cross-sectional area of the transfer tubes 94 and 96 from chamber 50 to chamber 52.

Finally, the exhaust or discharge pipe 144 from the final or uppermost chamber or compartment 54 to the atmosphere should equal 175% ±5% of the cross-sectional area in square inches of the engine exhaust pipe 64 where it enters the lower end of the muffler.

It should be pointed out that in instances where the transfer pipe or the exhaust pipe is not within the dimensional requirements to satisfy the required ratios, the next larger pipe size available should be used, and then a suitable restrictor cap or plate (such as 122 and 126) used in the inlet of the transfer pipe or exhaust pipe in order to meet the required cross-sectional area ratios.

I have determined that when the dimensional ratios are kept within the indicated ranges, and preferably near the stated optimum or preferred values, the engine can be made to run relatively cool and develop maximum horsepower, while having most of the sound developed at the exhaust pipe absorbed by the muffler of the invention.

Although a preferred embodiment of the invention has been herein described in order to enable those skilled in the art to understand the principles of the invention and to practice the invention, it will be understood that various changes can be effected in the described and illustrated embodiment without departure from the basic principles which underlie the invention. Changes of this character are therefore deemed to be circumscribed by the spirit and scope of the invention, except as the same may be necessarily limited by the appended claims or reasonable equivalents thereof.

What is claimed is:

1. A muffler for attenuating the sound developed during, and as a result of, operation of an internal combustion engine, said muffler comprising:

a double-walled cylindrical shell having an inner skin and an outer skin with said inner and outer skin defining a space therebetween;

solid particles of a sound attenuating material in the space between said inner skin and said outer skin;

a first end closure cap closing one end of said shell and defining an opening for receiving an exhaust gas pipe from an engine;

a second end closure cap closing the second end of said shell and defining an opening for passing a gas discharge pipe therethrough;

a plurality of partition plates within said cylindrical shell and partitioning the shell into at least three axially contiguous compartments;

an engine exhaust gas pipe projecting through the opening in said first end closure cap and into a first of said three compartments;

at least two pairs of elbow pipes connected to said exhaust gas pipe within said first compartment for receiving hot exhaust gases therefrom, the two elbow pipes in each of said pairs of elbow pipes having opposed, facing gas discharge openings so that gas streams discharged therefrom are caused to impinge against each other;

two gas transfer pipes extending through one of said partition plates, and each of said two gas transfer pipes having an intake opening located in said first compartment, and having a bent over end portion terminating in a discharge opening located in a second of said compartments, said discharge openings of said two gas transfer pipes facing toward each other in said second compartment so as to direct gas discharged from one of said two gas transfer pipes against gas discharged from the other of said two gas transfer pipes as said discharged gases from the transfer pipes co-mingle in said second compartment;

a pair of T-shaped transfer pipes each comprising:

an elongated pickup section in said second compartment and forming the cross bar of the respective T-shaped transfer pipe and said pickup section having a center and having a pair of opposite ends and having gas intake openings at each of said opposite ends thereof; and an elongated leg having a pair of opposite ends and having one of said opposite ends joined to the pickup section at about a center thereof, and said elongated leg projecting through a second of said partition plates into a third of said compartments, and having the other end of said elongated leg opposite from that one end which is connected to said pickup section defining a gas discharge opening; and a gas discharge pipe subassembly including a pipe extending through the opening in said second end closure cap, and having gas intake means within said third compartment, and having a discharge opening outside said cylindrical shell.

2. A muffler as defined in claim 1 wherein said solid particles of sound attenuating material comprise solid particles of cement.

3. A muffler as defined in claim 1 wherein gas discharge openings are defined in said other ends of said elongated legs of said T-shaped transfer pipe face toward each other so that the gases discharged through said discharge openings from T-shaped transfer pipes and within said third compartment impinge against each other, and the energy of said gases is dissipated by such mutual impingement as the gases are discharged from said facing gas discharge openings in said other ends of said elongated legs.

4. A muffler as defined in claim 1 wherein said first compartment is adjacent said first end closure cap, said third compartment is disposed within said cylindrical shell adjacent said second end closure cap, and said second compartment is located between, and contiguous to, said first compartment and said third compartment, said first compartment being largest of the three compartments, said second compartment being smaller than said first compartment, but larger than said third compartments, with said first compartment having a volume in cubic inches which is from about 580 to about 780 times the area in square inches of said engine exhaust line at the place where it enters the muffler through said first end closure cap, said second compartment having a volume in cubic inches which is between about 420 and 445 times the area in square inches of the engine gas discharge exhaust pipe where it enters the muffler through said first end closure cap and said third compartment having a volume in cubic inches which is from about 340 to about 360 times the cross-sectional area of the engine exhaust pipe at the place where the engine exhaust pipe enters the muffler through the first end closure cap.

5. A muffler as defined in claim 1 wherein said gas discharge pipe subassembly further comprises:

a pipe section having said gas intake means at its open opposite ends located within said third compartment; and a pipe section extending normal to said pipe section and passing through said second end closure cap and defining at its outer end said gas discharge opening of said gas discharge pipe subassembly.

6. A muffler for attenuating the sound developed during, and as a result of, operation of an internal combustion engine, said muffler comprising:

a cylindrical shell;

a first end closure cap closing one end of said shell and defining an opening for receiving an exhaust gas pipe from an engine;

a second end closure cap closing the second end of said shell and defining an opening for passing a gas discharge pipe therethrough;

a plurality of partition plates within said cylindrical shell and partitioning the shell into three axially contiguous compartments;

an exhaust gas pipe projecting through the opening in said first end closure cap and into a first of said three compartments;

at least two pairs of elbow pipes connected to said exhaust gas pipe within said first compartment for receiving hot exhaust gases therefrom, the two elbow pipes in each of said pairs of elbow pipes having opposed, facing gas discharge openings so that gas streams discharged therefrom are caused to impinge against each other;

two gas transfer pipes extending through one of said partition plates, and each of said two gas transfer pipes having an intake opening located in said first compartment, and having a bent over end portion terminating in a discharge opening located in a second of said compartments, said discharge openings of said two gas transfer pipes facing toward each other in said second compartment so as to direct gas discharged from one of said two gas transfer pipes against gas discharged from the other of said two gas transfer pipes as said discharged gases from the transfer pipes co-mingle in said second compartment;

a pair of T-shaped transfer pipes each comprising:

an elongated pickup section in said second compartment and forming the cross bar of the respective T-shaped transfer pipe and said pickup section having a center and having a pair of opposite ends and having gas intake openings at each of said opposite ends thereof; and an elongated leg having a pair of opposite ends and having one of said opposite ends joined to the pickup section at about a center thereof, and said elongated leg projecting through a second of said partition plates into a third of said compartments, and having the other end of said elongated leg opposite from that one end which is connected to said pickup section defining a gas discharge opening; and a gas discharge pipe subassembly including a pipe extending through the opening in said second end closure cap, and having gas intake means within said third compartment, and having a discharge opening outside said cylindrical shell.

* * * * *

UNITED STATES PATENT AND TRADEMARK OFFICE

CERTIFICATE OF CORRECTION

PATENT NO. : 5,076,393

DATED : December 31, 1991

INVENTOR(S) : Kenneth R. Howerton adn Derrell Smith

It is certified that error appears in the above-indentified patent and that said Letters Patent is hereby corrected as shown below:

Column 2, line 10, delete "soundsuppressor" and insert -sound-suppressor-
Column 2, line 48, delete "us" and insert -use-
Column 3, line 46, delete "double-waled" and insert -double-walled-
Column 5, line 5, delete "a" and insert - as -
Column 10, line 20, delete the "s" at the end of the word "compartments".

Signed and Sealed this

Seventh Day of December, 1993

*Attest:*

Bruce Lehman

BRUCE LEHMAN

*Attesting Officer*

*Commissioner of Patents and Trademarks*